US005596889A

United States Patent [19]

Guerra et al.

[11] Patent Number: 5,596,889

[45] Date of Patent: Jan. 28, 1997

[54] LAUNDRY MACHINE WITH REDUCED SUDS SPIN CYCLE

[75] Inventors: Lawrence E. Guerra, Roeland Park, Kans.; Craig S. Ruhl, Des Moines, Iowa

[73] Assignee: Electric Power Research Institute, Palo Alto, Calif.

[21] Appl. No.: 546,496

[22] Filed: Oct. 20, 1995

[51] Int. Cl.[6] ..... D06F 33/02

[52] U.S. Cl. ..... 68/12.02; 68/12.14

[58] Field of Search ..... 68/12.14, 23.3, 68/23.4, 24, 12.02; 8/159, 158

[56] References Cited

U.S. PATENT DOCUMENTS

| | | | |
|---|---|---|---|
| 2,218,698 | 10/1940 | Clark | 68/12.02 |
| 2,760,639 | 8/1956 | Haverstock . | |
| 2,881,633 | 4/1959 | Warhus | 68/24 |
| 3,093,842 | 6/1963 | Buss . | |
| 3,110,852 | 11/1963 | Brucken et al. | 68/12.14 |
| 3,152,462 | 10/1964 | Elliott et al. | 68/12.02 |
| 3,188,838 | 6/1965 | Hubbard | 68/12.02 |
| 3,287,752 | 11/1966 | Waldrop | 8/158 |
| 3,344,447 | 10/1967 | Candor et al. . | |
| 3,576,041 | 4/1971 | Marshall | 8/158 |
| 3,640,098 | 2/1972 | Eastall . | |
| 4,344,198 | 8/1982 | Arendt et al. . | |
| 4,410,329 | 10/1983 | Blevins et al. . | |
| 4,513,464 | 4/1985 | Rettich et al. | 8/159 |

(List continued on next page.)

FOREIGN PATENT DOCUMENTS

| | | |
|---|---|---|
| 0536542A1 | 4/1993 | European Pat. Off. . |
| 1528800 | 10/1978 | United Kingdom . |
| 1562777 | 3/1980 | United Kingdom . |
| 2055902 | 3/1981 | United Kingdom . |
| 2073257 | 10/1981 | United Kingdom . |
| 2145119 | 3/1985 | United Kingdom . |
| 2179683 | 3/1987 | United Kingdom . |
| 2197884 | 6/1988 | United Kingdom . |
| 2198456 | 6/1988 | United Kingdom . |
| 2239700 | 7/1991 | United Kingdom . |

OTHER PUBLICATIONS

Product Specification, Westinghouse Horizontal Washer, Model #LT350RXW1, Feb., 1994.

Product Specification, Hoover Horizontal New Wave 1300, Program 4, Dec., 1993.

Product Specification, Hoover Horizontal New Wave 1300 Program 2, Dec., 1993.

Product Specification, Siemens Horizontal Cycle Summary—B Seting (Normal Wash) Nov., 1993.

*Primary Examiner*—Frankie L. Stinson

*Attorney, Agent, or Firm*—Flehr, Hohbach, Test, Albritton & Herbert

[57] ABSTRACT

A laundry machine with a reduced suds spin cycle includes a laundry basket to hold laundry which contains a liquid, typically a water/detergent solution. A tub surrounds the laundry basket. A circular drainage void is formed between the laundry basket and the tub. A motor, responsive to a control circuit, rotationally drives the laundry basket. The control circuit modulates the motor such that the laundry basket achieves a first rotational speed sufficient to force substantially all of the laundry against the wall of the laundry basket. Then, a second rotational speed, greater than the first rotational speed, forces the water/detergent solution from the laundry into the circular drainage void. An intermediate rotational speed, substantially equivalent to the first rotational speed, is then used while water/detergent solution is removed from the circular drainage void, inhibiting suds formation. A third rotational speed, greater than the second rotational speed, is then used to force additional water/detergent solution from the laundry into the circular drainage void. The intermediate rotational speed and water/detergent removal operation may then be repeated. Thereafter, an increased rotational speed may be used. Operating in this fashion, the laundry machine continuously removes water/detergent solution to inhibit suds formation. Thus, the detrimental effects of excessive suds is avoided.

15 Claims, 3 Drawing Sheets

U.S. PATENT DOCUMENTS 4,631,771 12/1986 Anderson et al. ..... 68/12.14
4,782,544 11/1988 Nystuen et al. ..... 68/12.14
4,843,671 7/1989 Hirooka et al. ..... 68/12.14
5,171,435 12/1992 Nishimura et al. ..... 68/12.14
5,181,398 1/1993 Tanaka et al. ..... 68/12.14
5,191,668 3/1993 Euler et al. .
5,191,669 3/1993 Euler et al. .
5,219,370 6/1993 Farrington et al. .
5,233,718 8/1993 Hardaway .

LAUNDRY MACHINE WITH REDUCED SUDS SPIN CYCLE

BRIEF DESCRIPTION OF THE INVENTION

This invention relates generally to laundry machines. More particularly, this invention relates to a laundry machine with a spin cycle that minimizes the production of suds as a water/detergent solution is removed from clothes within the laundry machine.

BACKGROUND OF THE INVENTION

The production of excessive suds is a problem in laundry machines. The problem arises in both the wash and spin cycles. The present invention is directed toward suds production during spin cycles. Rapid rotational motion of the clothes basket within the tub of a laundry machine produces suds. More particularly, this rapid rotational motion produces turbulent air within the circular drainage void formed between the clothes basket and tub of a laundry machine. When a water/detergent solution from the laundry basket is forced into the circular drainage void by the centrifugal force of the rotating clothes basket, it combines with the turbulent air of the circular drainage void to generate suds. The suds can rapidly build up and fill the circular drainage void. The formation of suds in the circular drainage void is problematic because the spinning motion of the clothes basket subsequently shears and compresses the suds and can eventually produce a heavy and possibly excessive load on the laundry basket motor. In addition, the formation of suds in the circular drainage void may result in suds being forced into the clothes of the clothes basket. The formation of suds in the clothes basket is undesirable because the purpose of the spin cycle is to remove the water/detergent solution from the clothes in the clothes basket. The formation of excessive suds may result in a residual water/detergent solution remaining in the clothes. In view of the foregoing problems, it would be highly desirable to provide a laundry spin cycle with reduced suds production.

SUMMARY OF THE INVENTION

The invention is a laundry machine with a reduced suds spin cycle. The laundry machine includes a laundry basket to hold laundry which contains a liquid (water/detergent solution). A tub surrounds the laundry basket. A circular drainage void is formed between the laundry basket and the tub. A motor, responsive to a control circuit, rotationally drives the laundry basket. The control circuit modulates the motor such that the laundry basket achieves a first rotational speed sufficient to force substantially all of the laundry against the wall of the laundry basket. Then, a second rotational speed, greater than the first rotational speed, forces the water/detergent solution from the laundry into the circular drainage void. An intermediate rotational speed, substantially equivalent to the first rotational speed, is then used to allow water/detergent solution to be pumped from the circular drainage void. A third rotational speed, greater than the second rotational speed, is then used to force additional liquid from the laundry into the circular drainage void. The intermediate rotational speed and solution removal operation may then be repeated. Thereafter, an increased rotational speed may be used. Operating in this fashion, the laundry machine continuously removes water/detergent solution, inhibiting suds production.

The method of the invention includes the steps of plastering laundry against the wall of a laundry basket through the use of a first laundry basket rotational speed. Then, water/detergent solution is extracted from the laundry through the use of a second laundry basket rotational speed greater than the first laundry basket rotational speed. Water/detergent solution is then removed as the laundry is maintained against the wall of the laundry basket with an intermediate rotational speed substantially equivalent to the first laundry basket rotational speed. Additional water/detergent solution is then removed from the laundry through the use of a third laundry basket rotational speed greater than the second laundry basket rotational speed. The intermediate rotational speed may then be used as additional water/detergent solution is removed. Additional incremental speeds and intermediate rotational speeds with water/detergent solution removal may be used as desired.

The invention advantageously prevents an excessive build up of suds. The invention relies upon standard control techniques and equipment and may therefore be readily implemented in a variety of laundry machines.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION OF THE INVENTION

Figure 1:
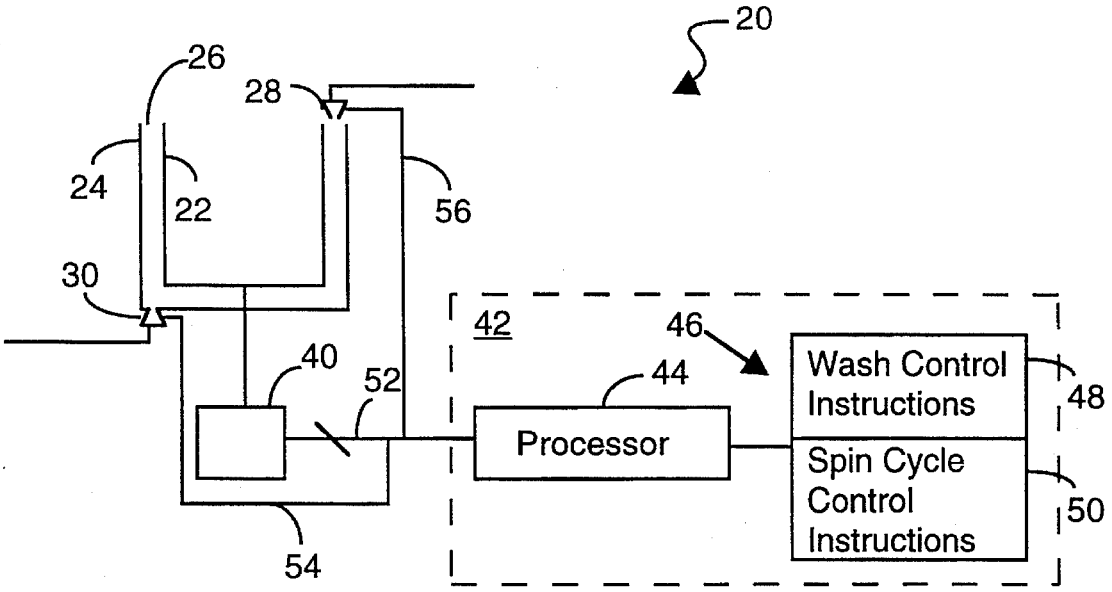
FIG. 1 is a simplified illustration of a laundry machine with a reduced suds spin cycle, in accordance with one embodiment of the invention.

FIG. 1 illustrates a laundry machine 20 with a reduced suds spin cycle, in accordance with one embodiment of the invention. The figure is simplified and is not to scale. The laundry machine 20 includes a laundry basket 22. As widely known, the laundry basket 22 receives laundry that is to be washed by the laundry machine 20. The laundry basket 22 is positioned within a tub 24. A circular drainage void 26 is defined between the laundry basket 22 and the tub 24. During the spin cycle of a washing machine, the laundry basket 22 is rotationally driven by a motor 40. The rotational motion of the laundry basket 22 centrifugally forces liquid (water/detergent solution) from the laundry in the laundry basket 22 through holes in the laundry basket (not shown) and into the circular drainage void 26. As indicated above, when the water/detergent solution is in the circular drainage void 26, it tends to form suds. The suds can then, undesirably, migrate back into the laundry basket 22 or create a detrimental frictional drag on the rotational movement of the laundry basket 22. This problem may be abated somewhat by using a water nozzle 28 to dilute the suds in the circular drainage void 26. Thereafter, the diluted suds may be drained through a water drain 30.

A control circuit 42 is used to control the operation of the motor 40, the nozzle 28, and the drain 30. It is generally known in the art how to make and use a laundry basket 22, a tub 24, a water nozzle 28, a water drain 30, a motor 40, and a control circuit 42. The present invention is directed toward a particular implementation of these elements such that a spin cycle is executed with reduced suds generation. This objective is achieved through a novel control circuit 42 which forces the laundry basket 22, the tub 24, the circular drainage void 26, the water nozzle 28, the water drain 30, and the motor 40 to operate in a novel manner. That is, these elements force laundry in the laundry basket 22 into a plastered state wherein they are centrifugally forced against the laundry basket walls. Then, the laundry is subjected to a sequence of extraction states with incrementally increasing rotational speeds that force additional liquid (water/detergent solution) from the laundry in the laundry basket. Between each extraction state, the plastered state is invoked. The plastered state has a lower rotational speed than the extraction states. Consequently, additional water/detergent is not forced into the circular drainage void 26 and therefore suds-forming water/detergent solution existing in the circular drainage void 26 has an opportunity to be removed. The removal of the suds can be enhanced by spraying water through the water nozzle 28. In a preferable embodiment, the rotational speed in the plaster state is still sufficient to keep the laundry against the basket walls. Thus, the clothes do not tumble and can otherwise be readily accelerated into another extraction state.

This overview of the invention will allow those skilled in the art to recognize a number of benefits associated with the disclosed technology. The primary benefit of the technology is that excessive suds are not allowed to form in the circular drainage void 26 since a rotational speed modulation of the laundry basket 22 allows suds-forming water/detergent solution to be extracted in an efficient and uniform manner. The invention is also advantageous in that it utilizes known and standard washing machine components. Thus, it is relatively easy and inexpensive to implement.

Attention now turns to a more detailed consideration of the invention. FIG. 1 illustrates the control circuit 42 implemented with a processor 44 that has an associated memory 46. The memory 46 stores a set of wash control instructions 48, which are used to execute a standard wash cycle operation typically performed before a spin cycle. The memory 46 also stores a set of spin cycle control instructions 50, which force the remaining elements of FIG. 1 to operate as previously specified. It should be recognized that the control circuit 42 may be implemented in software, in silicon, it may hardwired, or may be in any other analogous form known to those skilled in the art.

Figure 2:
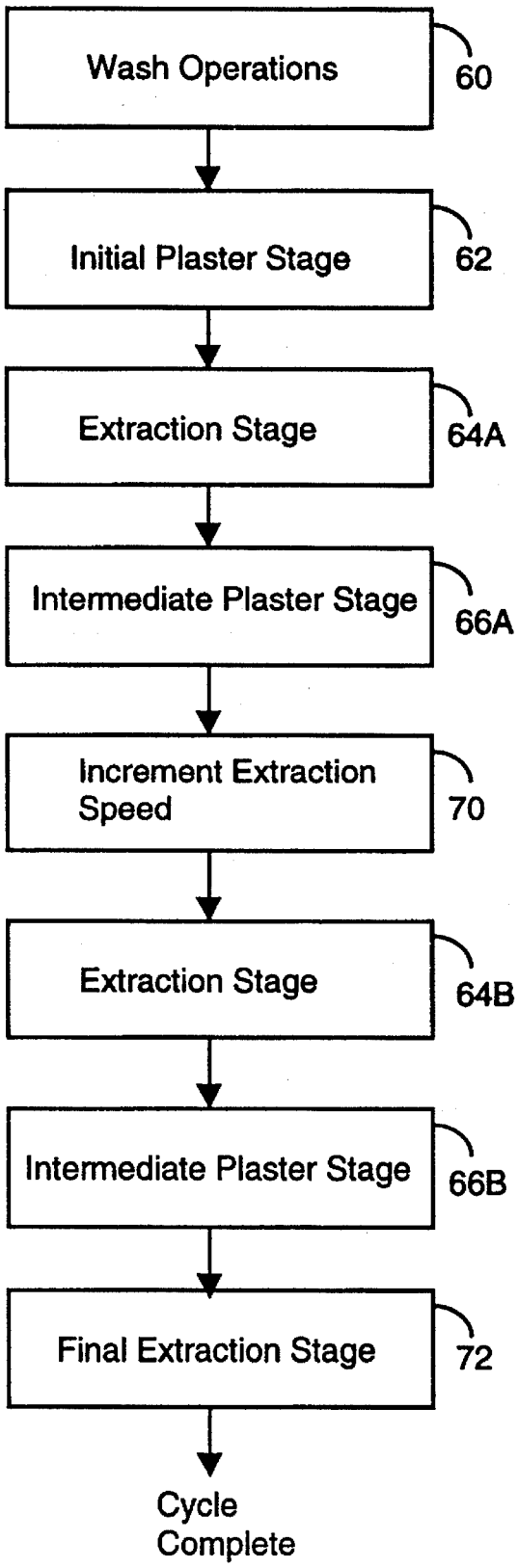
FIG. 2 illustrates the processing for a reduced suds spin cycle, in accordance with one embodiment of the invention.

The processing performed by the apparatus of the invention is more fully appreciated with reference to FIG. 2. The processing of the invention is typically initiated after standard wash operations are performed (block 60). Thus, the invention may be used in conjunction with any existing laundry cycle.

After the standard wash operations are performed, an initial plaster stage (block 62) is invoked. The function of the initial plaster stage (block 62) is to plaster, through centrifugal force, the laundry in the laundry basket 22 against the walls of the laundry basket 22. The speed required for the plaster stage is dependent upon the diameter of the laundry basket and the size of the laundry load. By way of example, for most residential laundry applications, the laundry basket 22 will be operated at approximately 80 revolutions per minute (rpms).

The next processing step illustrated in FIG. 2 is an extraction stage (block 64A). As its name indicates, the extraction stage serves to extract liquid, typically a water/detergent solution, from the laundry plastered against the laundry basket 22. The extraction stage of block 64A uses a laundry basket rotational speed greater than the speed associated with the initial plaster stage of block 62. The higher rotational speed forces liquid out of the laundry and into the circular drainage void 26. The turbulent air in the circular drainage void 26 tends to generate suds from the extracted liquid. Prior art cycles continue to raise the laundry basket rotational speed to extract additional liquid from the laundry, despite the fact that suds are rapidly and detrimentally forming in the circular drainage void 26. The present invention avoids this problem by imposing an intermediate plaster stage (block 66A) before invoking an increased rotational speed for the laundry basket. The intermediate plaster stage (block 66A) provides a laundry basket rotational speed substantially equivalent to the laundry basket rotational speed of the initial plaster stage (block 62). This relatively lower speed halts the generation of additional suds in the circular drainage void 26, but maintains the laundry in a plastered state. The water nozzle 28 can be used to spray water into the circular drainage void during the intermediate plaster stage (block 66A). This operation serves to further dilute the water/detergent solution and flush suds from the circular drainage void. Simultaneously, the water drain 30 is opened to allow the water/detergent solution and suds to vacate the tub 24. The next processing step of FIG. 2 is to increase the extraction speed (block 70). Thereafter, another extraction stage (block 64B) is executed with a higher extraction speed, thereby forcing additional liquid from the laundry. An intermediate plaster stage (block 66B) is then called. As before, the intermediate plaster stage (block 66B) sets the laundry basket rotational speed to a value substantially equivalent to that of the initial plaster stage (block 62).

Additional speed incrementation stages, extraction stages, and intermediate plaster stages may be used at this processing point. Whether the additional processing stages are used or not, the final processing step is a final extraction stage (block 72). This processing typically entails the cycle's highest laundry basket rotational speed, which is maintained for a relatively long period of time. Thereafter, the cycle is complete.

Figure 3:
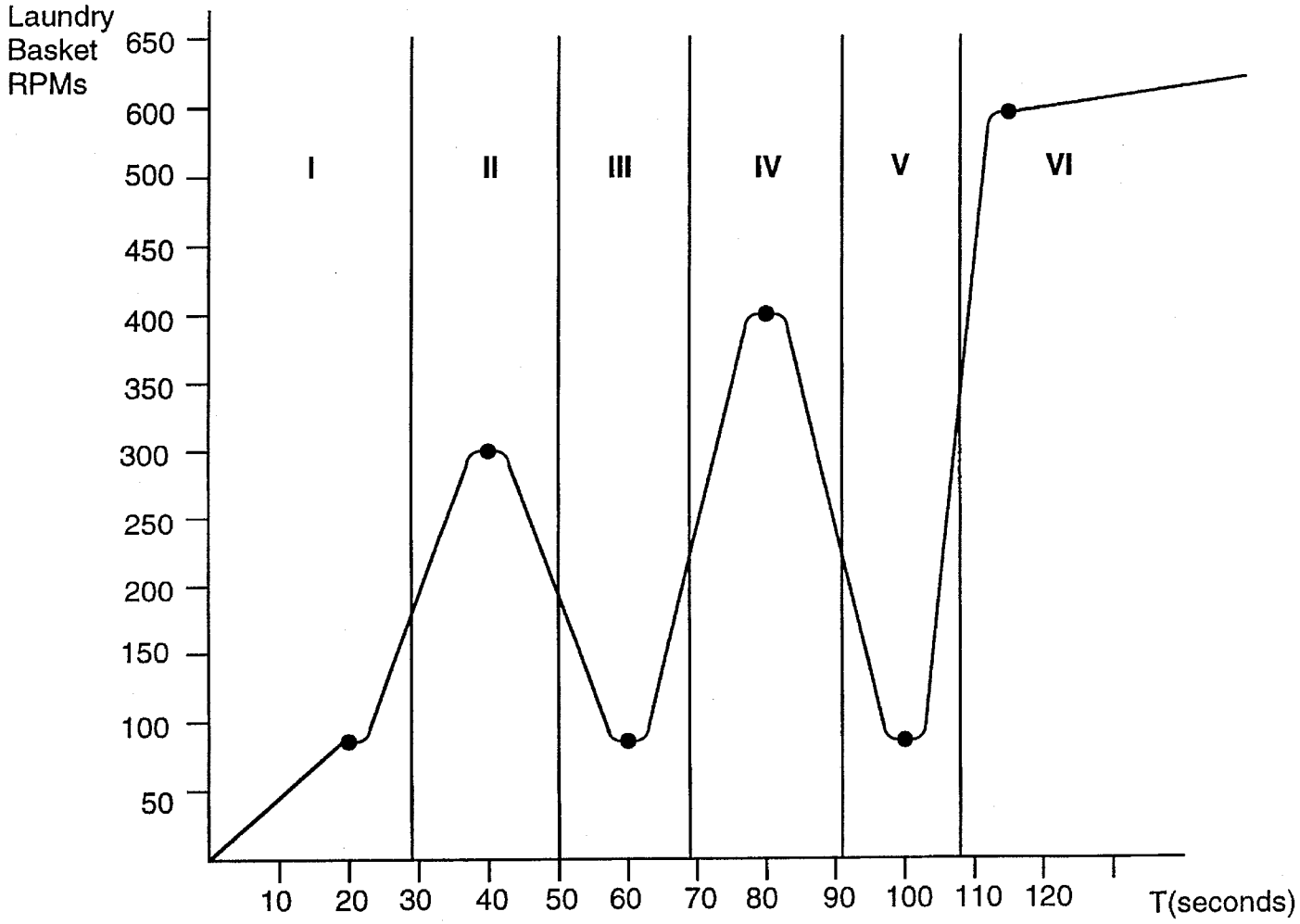
FIG. 3 illustrates laundry basket rotational speed as a function of time in accordance with one embodiment of the invention.

The processing described in relation to FIG. 2 is more fully appreciated with reference to FIG. 3. Region I of FIG. 3 shows the laundry basket rpms rising to a plaster speed of 80 rpms. This region corresponds to the initial plaster stage. Region II of FIG. 3 illustrates an initial extraction stage wherein the laundry basket speed rises to 300 rpms. Region III shows an intermediate plaster stage wherein the laundry basket rpm speed is once again brought down to a value of approximately 80 rpms. Region IV of FIG. 3 illustrates another extraction stage with a higher extraction speed of approximately 400 rpms. Region V shows an intermediate plaster stage consistent with the previous plaster stages. Finally, region VI illustrates a final extraction stage with the highest laundry basket speed of 600 rpms.

Those skilled in the art will recognize that the speed for each stage and the time spent in each stage will vary depending upon the application. However, one preferable embodiment of the invention used the following parameters. The initial plaster stage was set between 70 and 90 rpms, preferably approximately 80 rpms, for between 15 and 25 seconds, preferably approximately 20 seconds. A first extraction stage was used at between 225 and 300 rpms, preferably approximately 275 rpms, for between 10 and 20 seconds, preferably approximately 15 seconds. The first intermediate plaster stage was then set between 70 and 90 rpms, preferably approximately 80 rpms, for between 15 and 30 seconds, preferably approximately 25 seconds. The second extraction stage was then set between 300 and 400 rpms, preferably approximately 350 rpms, for between 10 and 20 seconds, preferably approximately 15 seconds. The second intermediate plaster stage was set between 70 and 90 rpms, preferably approximately 80 rpms, for between 15 and 30 seconds, preferably approximately 25 seconds. The final extraction stage was then set between 400 and 800 rpms, preferably at approximately 600 rpms rising to approximately 700 rpms, for between 10 and 30 seconds.

The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following Claims and their equivalents.

We claim:

1. A laundry machine, comprising:

a laundry basket to hold laundry which contains a liquid, said laundry basket including a basket base surrounded by a basket wall;

a tub surrounding said laundry basket and defining a circular drainage void therebetween;

a motor to rotationally drive said laundry basket; and a control circuit to modulate said motor such that said laundry basket achieves a first rotational speed sufficient to force substantially all of said laundry against said basket wall, a second rotational speed, greater than said first rotational speed, to force said liquid from said laundry into said circular drainage void, an intermediate rotational speed substantially equivalent to said first rotational speed, said intermediate rotational speed maintaining said laundry against said basket wall while reducing the suds formation associated with said second rotational speed, and a third rotational, speed greater than said second rotational speed, to force additional liquid from said laundry into said circular drainage void.

2. The laundry machine of claim 1 wherein said control circuit further modulates said motor such that said laundry basket achieves said intermediate rotational speed, and a final rotational speed, greater than said third rotational speed, to force additional liquid from said laundry into said circular drainage void.

3. The laundry machine of claim 1 further comprising a water nozzle to spray water into said circular drainage void to remove suds therefrom.

4. The laundry machine of claim 3 wherein said control circuit forces said water nozzle to spray water into said circular drainage void while said laundry basket operates at said first rotational speed.

5. The laundry machine of claim 4 further comprising a water drain positioned at the base of said tub to drain water/detergent solution therefrom.

6. The laundry machine of claim 5 wherein said control circuit opens said water drain while said laundry basket operates at said first rotational speed.

7. The laundry machine of claim 1 wherein said control circuit includes a processor with an associated memory storing a set of control instructions.

8. A laundry machine, comprising:

a laundry basket to hold laundry which contains a liquid, said laundry basket including a basket base surrounded by a basket wall;

a tub surrounding said laundry basket and defining a circular drainage void therebetween;

a motor to rotationally drive said laundry basket; and a control circuit to modulate said motor such that said laundry basket achieves an extraction stage rotational speed sufficient to extract said liquid from said laundry contained in said laundry basket; and a low suds plaster stage rotational speed sufficient to plaster said laundry against said basket wall while reducing the suds formation associated with said extraction stage rotational speed.

9. The laundry machine of claim 8 further comprising a water nozzle to spray water into said circular void to remove suds therefrom.

10. The laundry machine of claim 9 further comprising a water drain positioned at the base of said tub to drain water/detergent solution therefrom.

11. The laundry machine of claim 10 wherein said control circuit forces said water nozzle to spray water into said circular drainage void while said laundry basket operates at said low suds plaster stage rotational speed and said control circuit opens said water drain while said laundry basket operates at said low suds plaster stage rotational speed.

12. A laundry machine, comprising:

a laundry basket to hold laundry which contains a liquid, said laundry basket including a basket base surrounded by a basket wall;

a tub surrounding said laundry basket and defining a circular drainage void therebetween;

a motor to rotationally drive said laundry basket; and a control circuit to modulate said motor such that said laundry basket achieves a series of rotational speeds, said series comprising an extraction stage rotational speed sufficient to extract said liquid from said laundry contained in said laundry basket; and a low suds plaster stage rotational speed sufficient to plaster said laundry against said basket wall while reducing the suds formation associated with said extraction stage rotational speed.

13. The laundry machine of claim 12 further comprising a water nozzle to spray water into said circular void to remove suds therefrom.

14. The laundry machine of claim 13 further comprising a water drain positioned at the base of said tub to drain water/detergent solution therefrom.

15. The laundry machine of claim 14 wherein said control circuit forces said water nozzle to spray water into said circular drainage void while said laundry basket operates at said low suds plaster stage rotational speed and said control circuit opens said water drain while said laundry basket operates at said low suds plaster stage rotational speed.

* * * * *